US005145203A

United States Patent [19]

Gorza

[11] Patent Number: 5,145,203

[45] Date of Patent: Sep. 8, 1992

[54] SAFETY FASTENING, PARTICULARLY FOR SKIS

[75] Inventor: Roberto Gorza, Feltre, Italy

[73] Assignee: Nordica S.p.A., Montebelluna, Italy

[21] Appl. No.: 669,547

[22] Filed: Mar. 14, 1991

[30] Foreign Application Priority Data

Mar. 21, 1990 [IT] Italy ..... 82542 A/90

[51] Int. Cl.[5] ..... A63C 9/084

[52] U.S. Cl. ..... 280/632; 280/634

[58] Field of Search ..... 280/634, 632, 631, 628, 280/633

[56] References Cited

U.S. PATENT DOCUMENTS

| | | | |
|---|---|---|---|
| 3,830,510 | 8/1974 | Stauffor | 280/634 |
| 4,066,277 | 1/1978 | Murata | 284/631 |
| 4,444,413 | 4/1984 | Richert et al. | 280/632 |
| 4,615,536 | 10/1986 | Stritzl et al. | 280/631 |
| 4,792,157 | 12/1988 | Stritzl et al. | 280/632 |

*Primary Examiner*—David M. Mitchell

*Attorney, Agent, or Firm*—Guido Modiano; Albert Josif

[57] ABSTRACT

A ski fastening includes a rear engagement member provided with a lever with which a jaw is associated and engages the heel of a boot. The rear engagement member is constituted by a first body which is slidably associated with a base which is rigidly associated with the ski and to which the lever is pivoted. The first body includes an inclined plane which is connected through an adapted first tab to a first adjustment screw which is rotatably associated with the base, and one or more elements which are pivoted to the jaw at one end and slidably interact with the inclined plane at the other. The actuation of the first screw corresponds to an equal movement of both the inclined plane and the first body starting from the condition in which the rear engagement means is open.

4 Claims, 3 Drawing Sheets

SAFETY FASTENING, PARTICULARLY FOR SKIS

BACKGROUND OF THE INVENTION

Known safety fastenings usable in skis are currently usually constituted by a heel element and by a tip element, both of which are associated with the ski and are adapted to engage the usually standard ends of a ski boot.

Known heel elements in fact usually have a lever provided with a jaw which interacts with the heel region of the boot.

These heel elements furthermore have means for disengaging the boot as a consequence of an abnormal force exerted on the jaw and exceeding a selected value.

The disadvantage which can be observed in these known types of heel element is constituted by the fact that once the disengagement is obtained the skier must reopen the lever, usually loading one or more springs, in order to be able to fit the boot back into the fastening.

This operation is uneasy because the skier has to stoop to operate the heel element.

SUMMARY OF THE INVENTION

The aim of the present invention is therefore to eliminate the disadvantages described above in known types by providing a fastening having an effective automatic resetting even when the position of the heel element is varied with respect to the tip element, for adapting the fastening to the length of the sole.

Within the scope of the above aim, an important object is to provide a fastening wherein it is possible to reassociate the boot with said fastening in a rapid manner after a safety release has occurred.

Another important object is to provide a fastening wherein the skier can secure the boot to said fastening in an easy manner without stooping and without exerting an excessive manual effort directly to the heel element.

Another important object is to provide a fastening which is structurally simple.

Not least object is to provide a fastening which associates with the preceding characteristics that of being reliable and safe in use.

This aim, the objects mentioned and others which will become apparent hereinafter are achieved by a safety fastening, particularly for skis, comprising a rear engagement means provided with a lever, a jaw being associated with said lever and engaging the heel of an item of footwear, characterized in that said rear engagement means comprises a first body which is slidably associated with a base, said base being rigidly associated with said ski and said lever being transversely pivoted to said base, said first body comprising at least one inclined plane, said plane being connected by means of an adapted first tab to a first adjustment screw, said screw being rotatably associated with said base and being activated by the skier, and one or more elements having a first end pivoted to said jaw or lever and a second end slidably interacting with said at least one inclined plane, the actuation of said first screw imparting an equal movement to said at least one inclined plane and to said first body in the condition in which the rear engagement means is open.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENTS

Figure 1:
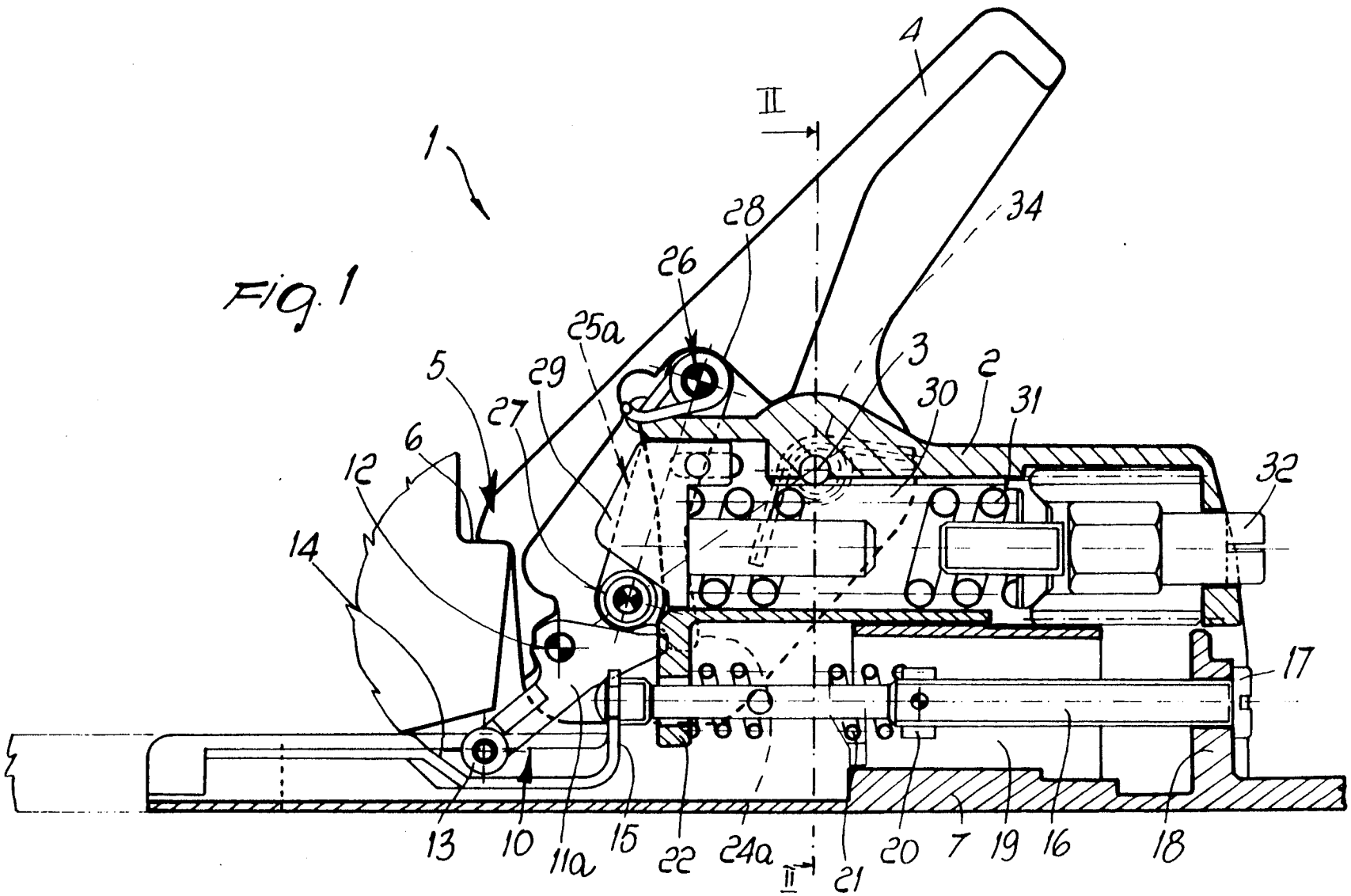
FIG. 1 is a side sectioned view of the heel element of a ski fastening according to the invention, in the condition in which the lever is closed.
Figure 3:
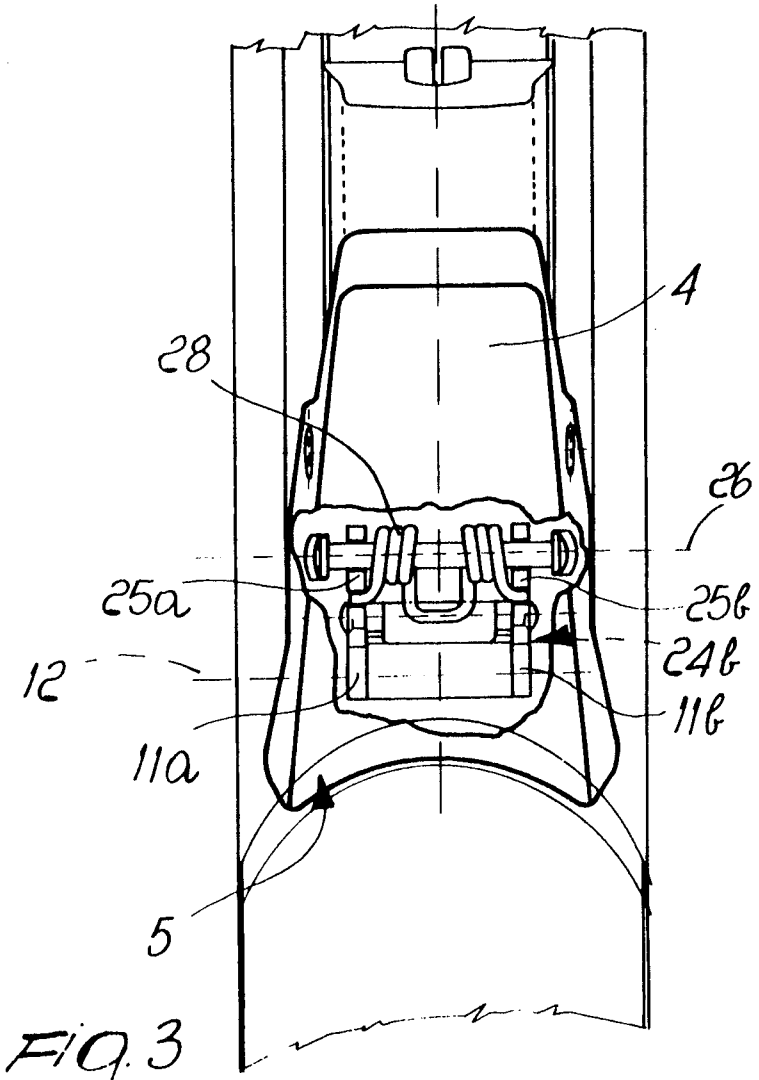
FIG. 3 is a partially sectional top view of the heel element.
Figure 2:
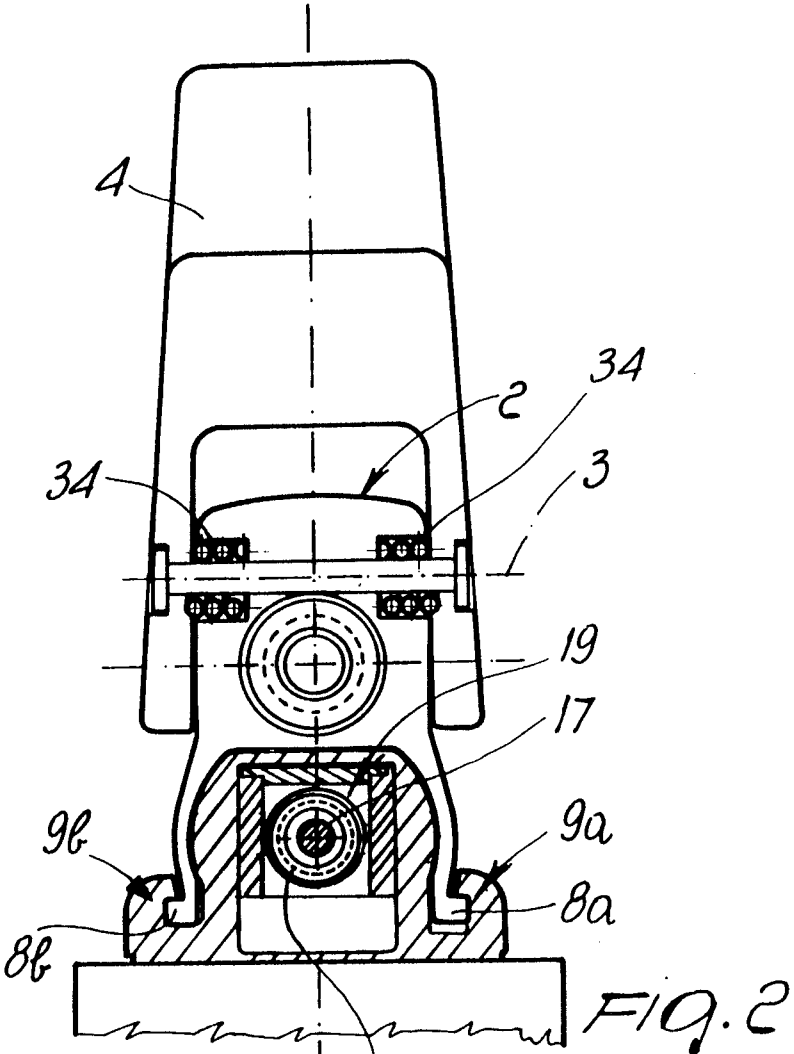
FIG. 2 is a sectioned view, according to the line II—II of FIG. 1.

With reference to the above figures, the reference numeral 1 indicates a rear engagement means, hereinafter also termed heel element, of a safety fastening; the heel element 1 comprises a first body, indicated by the reference numeral 2, and a lever 4 pivoted at the body 2 at a first axis 3 and having, at one end, a jaw 5 which is associated therewith or formed integral therein.

The jaw 5 interacts with the heel 6 of an item of footwear, such as for example a ski boot.

The first body 2 is slidably associated with a base 7 which is associated with a ski.

For this purpose, the first body 2 is laterally provided with a pair of first tabs 8*a* and 8*b* which are slidable at correspondingly shaped grooves 9*a* and 9*b* and are defined laterally and longitudinally with respect to the base 7.

The rear engagement means 1 furthermore comprises one or more elements which are associated with said jaw 5; said elements are constituted by a pair of pedals 10, optionally connected by a cross-member, each of which has, at its free ends, a head, indicated by the numerals 11*a* and 11 *b*, which has an essentially triangular configuration with a vertex directed in the opposite direction with respect to the heel 6 and is pivoted proximate to the base transversely to the jaw 5 at a second axis 12.

Advantageously, each pedal 10 can have one or more first rollers 13 at the base connecting the wings; the rollers interact with at least one first inclined plane 14 which is connected, by means of an adapted first tab 15, to the end of a first adjustment screw 16. The head 17 of the screw 16 is rotatably associated at an adapted threaded hole defined on a wall 18 which protrudes rearward with respect to the base 7.

A small cylinder 20 is associated at the stem of the first screw 16 inside a first cavity 19 arranged above said base 7, and a first spring 21 abuts thereon; at its other end, said spring interacts with a second tab 22 of said first body 2 which protrudes in the direction of the base 7 and is appropriately perforated for the passage of the first screw 16.

Said second tab 22 is interposed between the end of the first screw 16 which is connected to the first tab 15 an the cylinder 20.

Said first screw 16 allows to adapt the fastening to the length of the sole of the item of footwear, since the first body 2 can be moved backward, thus increasing the interspace for the mating of the sole with the fastening.

The presence of the first spring 21 allows the elastic recovery of the rear engagement means 1.

Figure 4:
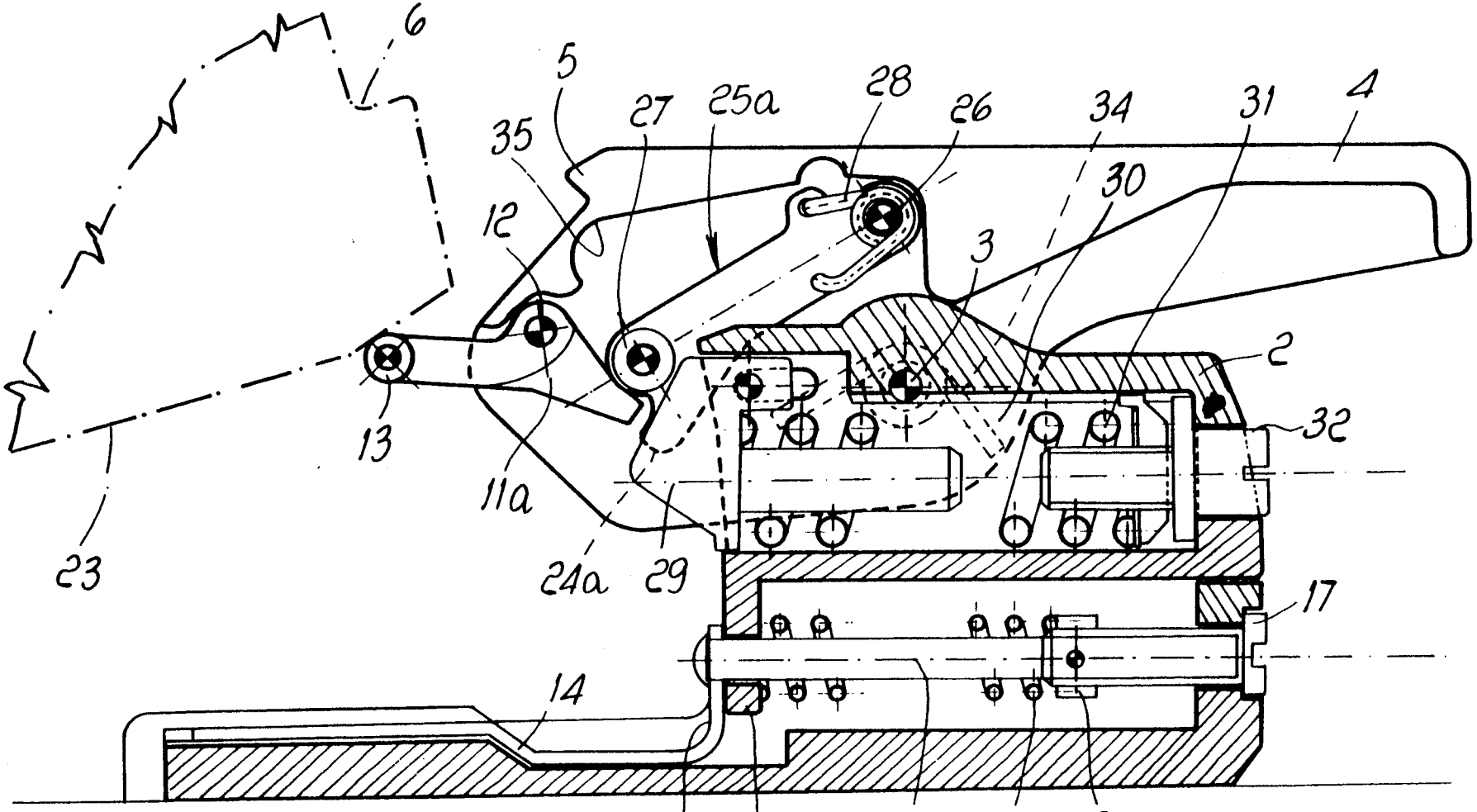
FIG. 4 is a view, similar to that of FIG. 1, of the heel element in the open condition.

The pedal 10 protrudes beyond the jaw 5 and in the condition in which the lever is open, as illustrated in FIG. 4, it can be activated directly by the sole 23 of the item of footwear.

The ends of the head 11*a* and 11*b* of the pedal 10 interact with an adapted pair of lugs 24*a* and 24*b* which protrude below a pair of connecting rods 25*a* and 25*b* which are freely pivoted, at the other end, at an adapted third axis 26, to the jaw 5 or to the lever 4.

Proximate to each lug 24*a* and 24*b*, on each of said connecting rods 25*a* and 25*b*, there are second rollers 27 which slidably interact with an underlying side of the heads 11*a* and 11*b* of the pedal 10.

A second spring 28 is arranged coaxially at the third axis 26 and coaxially to the pivot for the pivoting of the pair of connecting rods 25*a* and 25*b* to the jaw 5 or to the lever 4, and abuts at the underlying first body 2; said second spring 28 is loaded during the last portion of the counterclockwise rotation which can be imparted to the pair of connecting rods 25*a* and 25*b*, as described hereinafter.

The rear engagement means 1 furthermore comprises a cam 29 which is accommodated within an adapted second cavity 30 which is defined inside the first body 2 which lies above the first cavity 19.

A third spring 31 abuts inside the second cavity 30 at the cam 29 and controls, by adjusting a second screw 32 which can be accessed outside the first body 2, the release of the item of footwear in limit conditions from the rear engagement means 1.

The cam 29 furthermore interacts directly with the ends of the pair of connecting rods 25*a* and 25*b* which bear the second rollers 27.

The rear engagement means 1 furthermore comprises, at the first axis 3 for the pivoting of the lever 4 to the first body 2, a fourth spring 34 for contrasting the closure of the jaw 5 and/or of the lever 4.

The operation of the rear engagement means 1 is therefore as follows: considering the position illustrated in FIG. 1, and therefore when the lever 4 is closed and the item of footwear is associated with the fastening, the first body 2 advances with respect to the base 7 consequent to a force which causes a safety release.

Said advancement occurs due to the pressure imparted by the first spring 21, which forces the second tab 22 into abutment with the first wing 15.

During the forward sliding, the pedal 10, due to its interaction with the inclined plane 14, rotates at the second axis 12, thus releasing the lugs 24*a* and 24*b*.

The pair of connecting rods 25*a* and 25*b* is therefore consequently free to rotate at the third axis 26, thus unloading the second spring 28 and simultaneously allowing the rotation of the jaw 5 at the first axis 3.

The rotation of the pair of connecting rods 25*a* and 25*b* ends against the facing internal wall 35 of the jaw 5.

During this rotation, the second spring 28 furthermore unloads completely until it separates from the underlying first body 2 and thus rotates together with the pair of connecting rods 25*a* and 25*b*.

The rotation of the jaw 5 instead continues up to the complete opening thereof due to the third spring 34, making the cam 29 pass beyond the pair of connecting rods 25*a* and 25*b*.

These last, during the step of complete opening, move away from the internal wall 35 of the jaw 5 simply by gravity, since they are no longer subjected to the effect of the second spring 28.

The rear engagement means is thus ready to be engaged with the boot again.

In order to achieve the closing, it is in fact sufficient to move the heel of the item of footwear at the pair of pedals 10, or at the cross-member which connects them, imparting thereto a movement toward the ski until said heel is engaged at the jaw 5.

In this manner, the third spring 31 does not contrast the first step of the rotation, since the pair of connecting rods 25*a* and 25*b* does not press at the cam 29, because the lugs 24*a* and 24*b* and the ends of the heads 11*a* and 11*b* of the pedal 10 are not mutually engaged.

The only reaction to be overcome in this step is therefore exclusively that of the fourth springs 34 (for the rotation of the jaw 5) and of the first spring 21 (rearward movement of the first body 2).

The second step of the closing begins at a given angular position of the jaw 5; the ends of the heads 11*a* and 11*b* of the pedal 10 abut at the lugs 24*a* and 24*b*, and the reaction of the third spring 31 intervenes since the pair of connecting rods 25*a* and 25*b* moves rigidly with the jaw 5 and the pedal 10, pressing against the cam 29.

The fact is stressed that starting from the condition in which the fastening is open, as illustrated in FIG. 4, an adjustment performed on the head 17 of the first screw 16 achieves an equal movement of both the inclined plane 14 and of the first body 2 with which at least one pedal 10 is associated.

This means that once the fastening is closed the same engagement and resetting conditions can be obtained even though boots of different size are put on.

It has thus been observed that the invention has achieved the intended aim and objects, a safety fastening having been obtained wherein the rear engagement means has the peculiarity of allowing to maintain the same conditions for release and automatic resetting as the position of the heel element varies with respect to the tip element, this being obtained by adjusting the first screw 16.

Said automatic resetting, i.e. the ability to open consequent to a safety release so as to be ready to subsequently accommodate the item of footwear to be engaged, is very easy for the skier.

The skier can in fact re-engage the boot in a rapid and easy manner and without acting manually directly on the lever and therefore without having to stoop.

The fastening according to the invention is naturally susceptible to numerous modifications and variations, all of which are within the scope of the same inventive concept.

The materials and dimensions which constitute the individual elements of the fastening according to the invention may also naturally be the most pertinent according to the specific requirements.

I claim:

1. Safety fastening, particularly for a ski, comprising a rear engagement means provided with a lever, a jaw for engaging a heel of an item of footwear being associated with said lever, said rear engagement means further comprising a first body and a base element, said base element being rigidly connectable to said ski and said first body being slidably supported by said base element, said lever being transversely pivoted to said base element, said first body comprising at least one inclined plane connected thereto and arranged above said base element, said rear engagement means further comprising at least one pedal element which is pivotally connected to said lever at a first end thereof and which is provided with a second end for slidably interacting with said at least one inclined plane, said at least one pedal comprising means for sliding at said second end thereof which comprise a first roller elements, said at least one inclined plane being connected by means of a first tab element thereof to a first adjustment screw, said first adjustment screw being rotatably associated in a threaded hole defined on a wall of said base which protrudes rearwardly therefrom, and thereby an actuation of said first adjustment screw imparts an equal movement to said at least one inclined plane and to said first body of said rear engagement means.

2. Safety fastening according to claim 1, wherein said first body (2) is laterally provided with a pair of tab elements (8*a*,8*b*) which are slidably accommodated in correspondingly shaped grooves (9*a*,9*b*) provided in said base element (7).

3. Safety fastening according to claim 1, wherein said first body comprises a second tab (22) through which said first adjustment screw (16) extends, said first adjustment screw further comprising a cylinder element (20) concentrically connected thereto, a first spring (21) being interposed between said cylinder element and said second tab for biasing said second tab against said first tab element (15) of said inclined plane (14).

4. Safety fastening according to claim 1, wherein said first body comprises a longitudinal cavity (30) in which an adjustable spring-biased cam element (29) is accommodated, said rear engagement means further comprising a spring-biased, connecting rod means (25*a*,25*b*) which is pivoted to said lever (4), said pedal (10) comprising in a position opposite to said first roller (13) a head 11*a*, 11*b*) for lockingly engaging with lug means (24*a*, 24*b*) provided at a lower end of said connecting rod means, said connecting rod means further comprising at said lower end thereof a second roller (27) which is interposable between said cam element and said heat of said pedal.

* * * * *